United States Patent [19]

Weeks

[11] Patent Number: 5,000,449

[45] Date of Patent: Mar. 19, 1991

[54] BASEBALL PITCHING TRAINER

[76] Inventor: Douglas Weeks, Box 289, Oroville, Wash. 98844

[21] Appl. No.: 575,841

[22] Filed: Aug. 31, 1990

[51] Int. Cl.[5] ..... A63B 69/00

[52] U.S. Cl. ..... 273/26 R; 273/26 A

[58] Field of Search ..... 273/26 R, 25, 26 D, 273/26 A

[56] References Cited

U.S. PATENT DOCUMENTS

| | | | |
|---|---|---|---|
| D. 263,979 | 4/1982 | Van Gepen | 273/25 |
| 3,236,521 | 2/1966 | Freidman | 273/26 R |
| 3,703,285 | 11/1972 | Perry et al. | 273/25 |
| 3,837,646 | 9/1974 | Goeders | 273/25 |
| 4,063,729 | 12/1977 | Holloway | 273/25 |
| 4,194,735 | 3/1980 | Wilson | 273/26 R |
| 4,306,718 | 12/1981 | Goeders | 273/25 |
| 4,666,155 | 5/1987 | Stille | 273/25 |
| 4,749,223 | 6/1988 | Goeders | 273/25 |
| 4,925,186 | 5/1990 | Stevenson et al. | 273/25 |

*Primary Examiner*—Theatrice Brown

*Attorney, Agent, or Firm*—H. Jay Spiegel

[57] ABSTRACT

Disclosed is a baseball pitching trainer designed to teach a prospective pitcher the proper pitching stance as well as the proper body orientation which is used to effectively throw a baseball. The device includes a target, a mat having foot engaging portions and a mechanism designed to support a ball at an elevation and orientation so that it may be properly grasped by the pitcher to effectively pitch the ball.

8 Claims, 3 Drawing Sheets

BASEBALL PITCHING TRAINER

BACKGROUND OF THE INVENTION

Training devices designed to be used to train athletes in various athletic pursuits are known. U.S. Pat. No. 4,194,735 to Wilson discloses a device designed to teach the proper footwork for batting. U.S. Pat. No. 4,863,166 to Becera et al. discloses a throwing target which is adjustable as to the target opening. However, neither of these patents nor any prior art known to Applicant teaches a device designed to teach the proper body orientation for throwing a baseball.

SUMMARY OF THE INVENTION

The present invention relates to a baseball pitching trainer. The present invention includes the following interrelated aspects, objects and features:

(A) In a first aspect, the inventive baseball pitching trainer includes a target which may consist of a net device having a frame and a base supporting the frame with the net having a target area designed in any known manner.

(B) A mat is provided which includes a simulated "rubber" area, marked regions designed to have the feet of the pitcher placed thereover and landing areas for each foot separated by a divider.

(C) A tee mechanism is mounted on a telescoping support extending upwardly from a base. The tee mechanism includes a ball storage area and a tee designed to receive one ball at a time.

(D) In the preferred mode of operation of the present invention, the tee mechanism is located with respect to the mat in such a manner that the pitcher standing on the foot receiving regions of the mat will grasp a ball from the tee only when the pitcher's stance is appropriate for throwing the baseball in the correct manner.

As such, it is a first object of the present invention to provide an improved baseball pitching trainer.

It is a further object of the present invention to provide such a device having a target, a mat and a tee mechanism.

It is a still further object of the present invention to provide such a tee mechanism having ball storage device along with a tee designed to receive one ball at a time and intended to be positioned at a location wherein the pitcher may grasp a ball only when the pitcher has adopted the proper pitching stance.

These and othe objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 2:
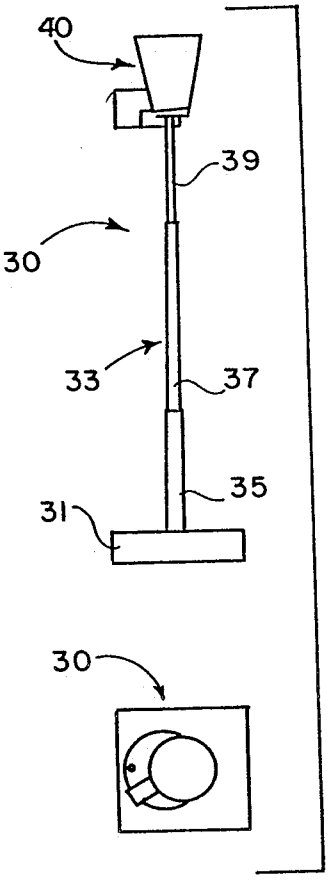
FIG. 2 shows a top view of the trainer illustrated in FIG. 1.
Figure 1:
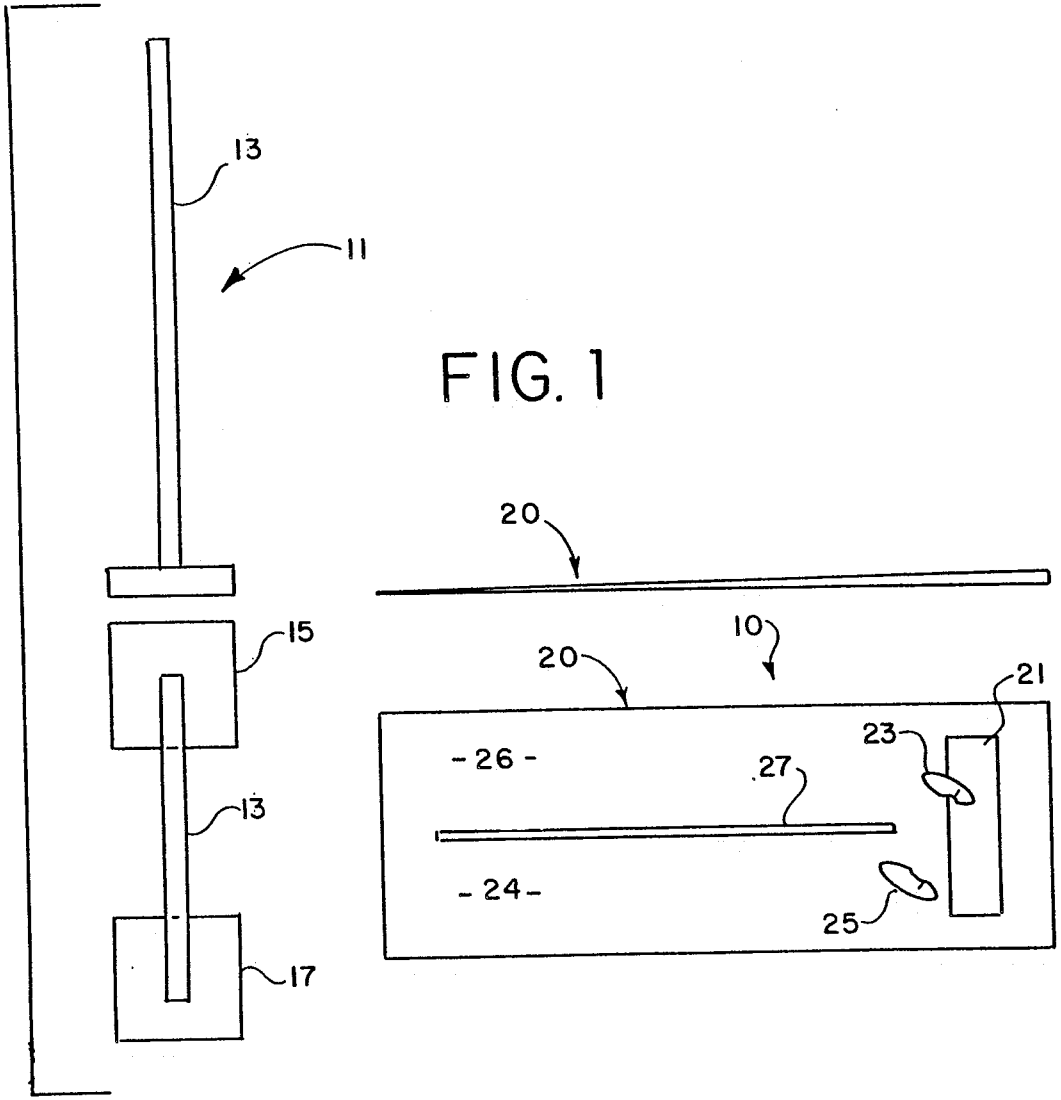
FIG. 1 shows a side view of the inventive baseball pitching trainer.
Figure 4:
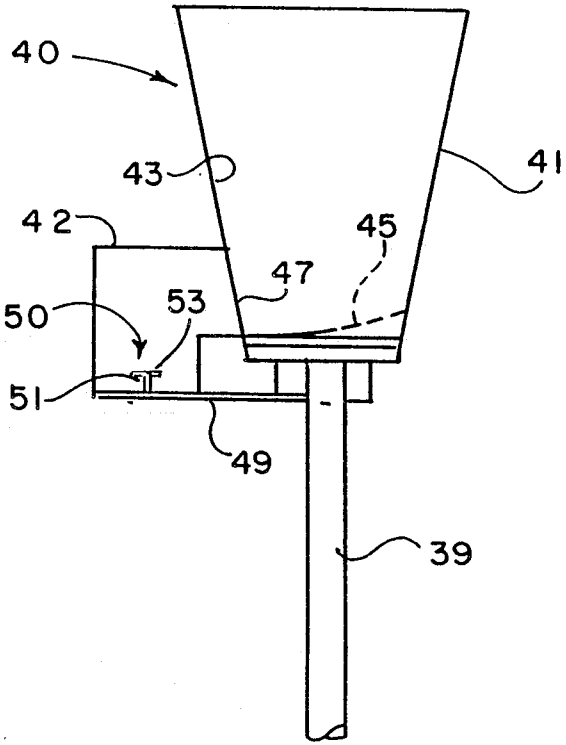
FIG. 4 shows a close-up side view of a portion of the tee mechanism.

With reference, first, to FIGS. 1 and 2, the inventive baseball pitching trainer is generally designated by the reference numeral 10 and is seen to include a target 11 including supports 15, 17 and a frame 13 supporting a net in a manner well known to those skilled in the art.

The inventive baseball pitching trainer 10 further includes a mat 20 having a region 21 designed to simulate the pitching "rubber", footprints 23, 25 designed to receive, in overlaying relation, the feet of the pitcher, and a divider 27 dividing the majority of the mat 20 into two landing areas, a landing area 24 for the left foot and a landing area 26 for the right foot.

With futher reference to FIGS. 1 and 2, a tee mechanism is generally designated by the reference numeral 30 and is seen to include a base 31 which may, if desired, include an internal chamber which may be filled with water or sand to increase the base weight and, thereby, the stability of the tee mechanism 30. A support pole 33 extends upwardly from the base 31 and is preferably of a telescoping design including telescoping rods 35, 37 and 39. With such structure, the rod 33 may be extended to any desired height. Mounted on top of the top rod 39 is a ball holder 40 along with a loading mechanism and tee to be described in greater detail hereinafter.

Figure 3:
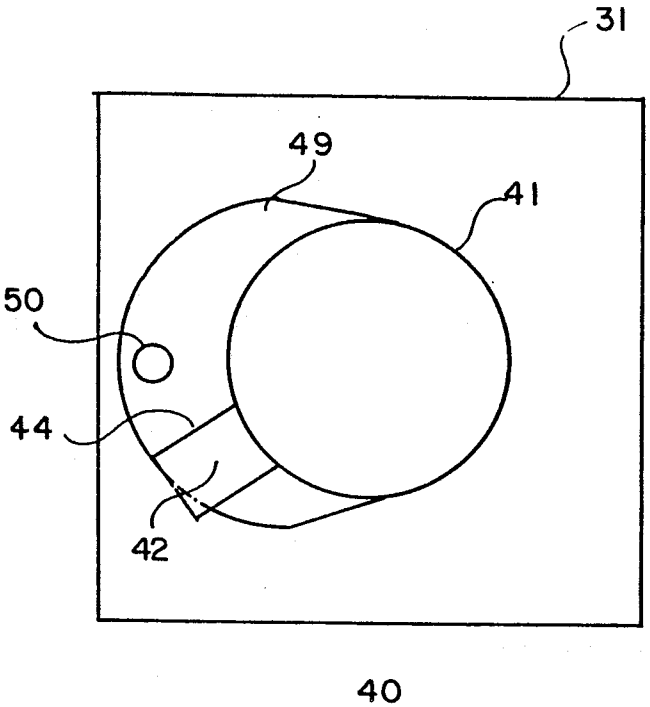
FIG. 3 shows a top view of the tee mechanism of the present invention.
Figure 6:
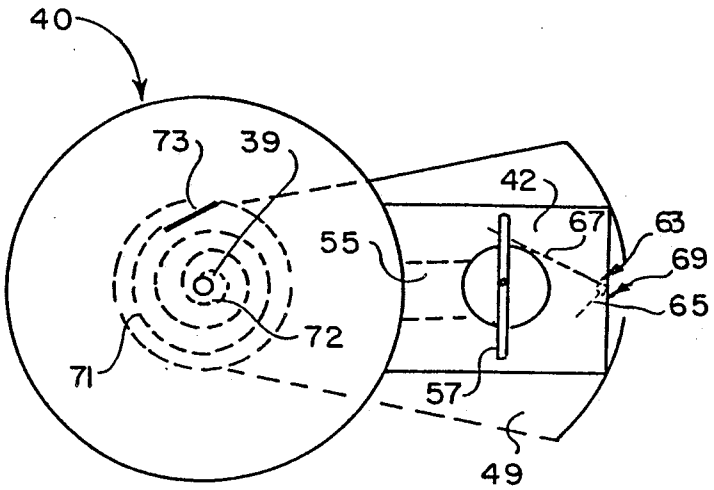
FIG. 6 shows a top view of the tee mechanism with portions broken away to show detail.
Figure 5:
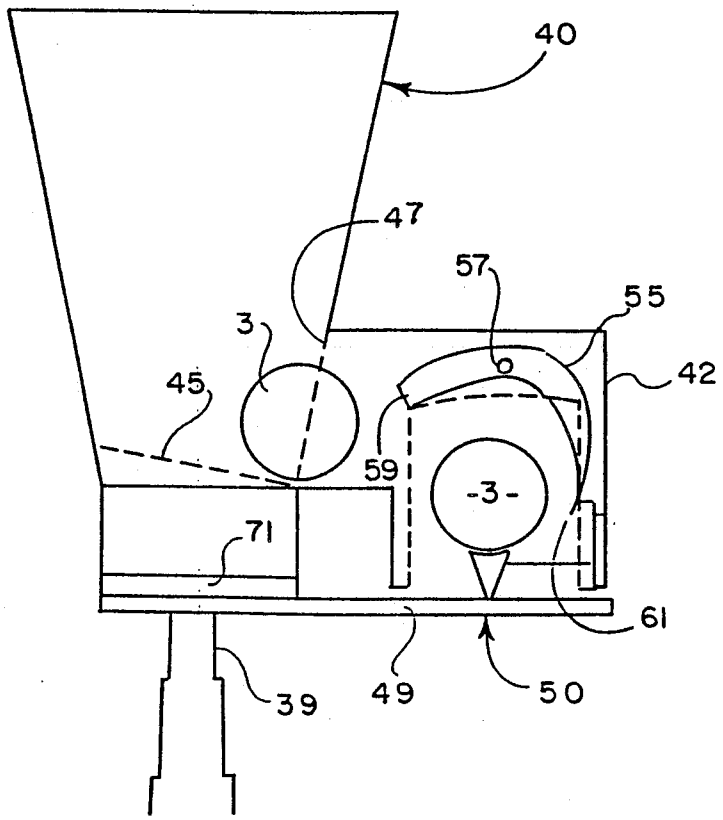
FIG. 5 shows a further close-up side view of the tee mechanism with portions broken away to show detail for causing a single ball to be placed on the tee.

With particular reference to FIGS. 3–6, the ball holder 40 is seen to include a container 41 having an internal chamber 43 and a bottom surface 45 angled in the direction of a single outlet 47 (FIG. 5). An elbow 42 leads a ball 3, which is travelling through the opening 47, to the support surface 53 of a tee 50 which also includes a rod 51. The elbow 42 includes a side opening 44 allowing rotation of the plate 49 carrying the tee 50 so that the tee 50 may enter the chamber defined by the elbow 42. FIG. 3 shows the tee 50 on the plate 49 in a position with the tee 50 outside the elbow 42. With particular reference to FIGS. 5 and 6, it is seen that the plate 49 is pivotably mounted on the uppermost rod 39 and a spring 71 is mounted with one end 72 fixed to the rod 39 and with another end 73 fixed to the plate 49. When the plate 49 is in the position shown in FIG. 3, the spring 71 is in a relaxed state. When the plate 49 is rotated counterclockwise in the view of FIG. 3 to cause the tee 50 to enter the chamber defined by the elbow 42, such rotative movement causes tensioning of the spring 71 creating a biasing force tending to want to rotate the plate 49 in the clockwise direction in the view of FIG. 3.

A catch block 55 is pivotably mounted within the elbow 42 on fulcrum pin 57. The catch block 55 has a rear end 59 designed to restrict the area of movement of a ball 3 therepast when in the position shown in FIG. 5. With further reference to FIG. 5, the catch block 55 has an opposite end 61 which may be engaged by the release pin 63 to allow pivoting of the catch block 55 about the fulcrum pin 57 in the clockwise direction in the view of FIG. 5 to allow enlarging of the region normally blocked by the end 59 of the catch block 55 to allow a single ball 3 to move therepast and onto the tee 50.

With particular reference to FIGS. 5 and 6, it is seen that the release pin 63 includes a short leg 65 and an elongated leg 67 and the release pin 63 is pivotably mounted on a pivot 69. As should be understood from comparison of FIGS. 5 and 6, when the plate 49 with tee 50 thereon is pivoted into the chamber defined by the elbow 42, the tee 50 support 53 will engage the leg 67 of the release pin 63 thereby pivoting the release pin in the clockwise direction in the view of FIG. 6. Such movement of the release pin 63 will cause the leg 65 thereof to engage the end 61 of the catch block 55, thereby causing the catch block 55 to pivot in the clockwise direction in the view of FIG. 5 thereby causing the end 59 of the catch block 55 to be pivoted to allow an opening large enough to allow a ball 3 to move therepast and onto the tee 50. After this procedure has been followed, the user may let go of the plate 49 causing the plate 49 to rotate in the clockwise direction in the view of FIG. 3 to restore the tee 50 now having a ball 3 thereon back to the position shown in FIG. 3. In this position, with the tee mechanism 30 having been placed with respect to the mat 20 in spacing and elevation as appropriate, a ball 3 as placed on the tee 50 may be grasped by the pitcher during the pitching motion.

In the operation of the present invention, the target 11 and mat 20 are placed in an appropriate relationship as illustrated in FIGS. 1 and 2. The tee mechanism 30 is also placed in an appropriate mechanism based upon the desired throwing motion of the pitcher. In this regard, the ball holder 40 is elevated to the desired elevation by extending the rods 35, 37 and 39 as desired. As should be understood by those skilled in the art, frictional forces may be used to retain the specific degree of extension of the rods 35, 37 and 39. Alternatively, other means for maintaining the degree of extension may be employed including screws and nuts.

The container 41 may be filled with baseballs and at this point the pitcher is ready to begin. Before adopting the appropriate pitching stance, the pitcher rotates the plate 49 in the counterclockwise direction in the view of FIG. 3 to cause the tee 50 to enter the chamber defined by the elbow 42. Such entry, with particular reference to FIGS. 5 and 6, causes the tee 50 to engage the leg 67 of the release pin 63 thereby causing the release pin 63 to rotate in the clockwise direction in the view of FIG. 6 causing the leg 65 thereof to engage the end 61 of the catch block 55, thereby causing the catch block 55 to pivot in the clockwise direction in the view of FIG. 5 to cause the end 59 thereof to be rotated to a sufficient degree to allow the ball 3 to move therepast and onto the tee 50. While the plate 49 is being moved in the counterclockwise direction in the view of FIG. 3, such movement causes tensioning of the spring 71 so that after a ball 3 has been automatically placed on the tee 50, release of the plate 49 by the hand of the user will cause automatic rotation of the plate 49 in the clockwise direction in the view of FIG. 3 to restore the location of the tee 50, now having a ball thereon, to the position shown in FIG. 3. In this position, the pitcher may adopt the appropriate stance for pitching including placing of the pitcher's feet over the outlines of feet 23, 25, best seen in FIG. 2. The pitcher may use the appropriate pitching motion including moving the pitching hand to a position where a ball 3 may be grasped off the tee 50 with the palm of the pitcher's pitching hand facing downwardly, whereupon the throwing motion may be completed with the left foot landing in the landing area 24 and with the right foot landing in the landing area 26 thereafter.

This procedure may be repeated until the supply of baseballs in the container 41 has been exhausted. At this point, the baseballs may be collected and may be replaced in the container 41 for continuing instruction into the specific techniques of pitching a baseball.

As stated above, the base 31 may include a chamber which may be filled with balast such as water or sand. In the preferred embodiment of the present invention, the base 31 comprises a plastic tank.

In a further aspect, the extensible rod 33 preferably will allow adjustment of the elevation of the ball holder 40 from thirty to seventy-two inches off the ground.

In a further aspect, if desired, the net attached to the frame 13 may, if desired, have an adjustable target allowing adjustment of the location where pitches are to be thrown laterally as well as vertically.

As such, an invention has been disclosed in terms of a preferred embodiment thereof which fulfills each and every one of the objects of the invention as set forth hereinabove and provides a new and improved baseball pitching trainer of great novelty and utility. Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A baseball pitching trainer, comprising:
(a) a simulated pitching rubber;
(b) foot engaging regions adjacent said rubber;
(c) a target aligned with said rubber; and
(d) a tee mechanism including:
(i) a base adapted to rest on a ground surface;
(ii) a support extending upwardly from said base;
(iii) a ball holder mounted on said base and adapted to store a plurality of balls; and
(iv) a tee mounted in adjacency to said holder and adapted to support a single ball thereon;
(e) whereby a pitcher may stand on said rubber using said foot engaging regions to adopt a proper pitching stance, and may only reach said single ball during a proper pitching motion.

2. The invention of claim 1, wherein said rubber and foot engaging regions are located on a mat.

3. The invention of claim 1, wherein said target includes a frame and a net mounted on said frame.

4. The invention of claim 1, wherein said base includes a chamber adapted to receive a selected amount of ballast.

5. The invention of claim 1, wherein said support comprises an adjustable telescoping support.

6. The invention of claim 1, wherein said tee is mounted on a plate pivotably supported on said support.

7. The invention of claim 6, wherein said ball holder includes a storage chamber having an outlet and an elbow connected to said outlet and alignable with said tee in one rotative position of said plate.

8. The invention of claim 7, further including a catch block pivotably mounted in said elbow and having an end blocking said outlet in one pivotable position thereof, said catch block being pivotable to a position wherein said outlet is unblocked responsive to said tee and plate being pivoted to a position wherein said tee enters said elbow.

* * * * *